US009643311B1

(12) United States Patent
Cowie

(10) Patent No.: US 9,643,311 B1
(45) Date of Patent: May 9, 2017

(54) OCTAGONAL EXTENSION HANDLE

(71) Applicant: Marshalltown Company, Marshalltown, IA (US)

(72) Inventor: Charles Henry Cowie, Fayetteville, AR (US)

(73) Assignee: Marshalltown Company, Marshalltown, IA (US)

( * ) Notice: Subject to any disclaimer, the term of this patent is extended or adjusted under 35 U.S.C. 154(b) by 0 days.

(21) Appl. No.: 14/725,370

(22) Filed: May 29, 2015

Related U.S. Application Data

(63) Continuation-in-part of application No. 29/488,143, filed on Apr. 16, 2014, now Pat. No. Des. 735,012.

(51) Int. Cl.
*B25G 1/04* (2006.01)

(52) U.S. Cl.
CPC ..... *B25G 1/04* (2013.01)

(58) Field of Classification Search
CPC . Y10T 16/473; Y10T 16/4719; Y10T 16/498; Y10T 16/4554; Y10T 403/32467; Y10T 403/598; Y10T 403/7079; Y10T 403/32475; Y10T 15/10; Y10T 29/537; A47L 9/32; B25G 1/04; B25G 3/12; B25G 3/18; B25G 3/04; B05C 17/0205; F16B 7/10; F16B 7/105; F16B 7/042; B21D 39/04; B21D 39/046; B21D 39/048
See application file for complete search history.

(56) References Cited

U.S. PATENT DOCUMENTS

| | | | | |
|---|---|---|---|---|
| 293,752 | A | 2/1884 | Krahenbeihl et al. | |
| 1,928,009 | A | 9/1933 | Dornier | |
| 1,963,057 | A | 6/1934 | Wilcox | |
| 2,018,890 | A | 10/1935 | Heltzel | |
| D214,828 | S | 8/1969 | Kroener | |
| D217,285 | S | 4/1970 | Anderson | |
| 3,972,529 | A | 8/1976 | McNeil | |
| D245,756 | S | 9/1977 | McKee | |
| 4,397,581 | A | 8/1983 | Jarvis | |
| 4,406,559 | A * | 9/1983 | Geertsema | B25G 3/18 15/145 |
| D282,622 | S | 2/1986 | Bobo | |
| 4,739,994 | A * | 4/1988 | Lewis, Jr. | A63B 60/08 273/DIG. 23 |
| 4,940,243 | A | 7/1990 | Tucker et al. | |
| D323,280 | S | 1/1992 | Chen | |
| 5,467,496 | A | 11/1995 | Jarvis | |
| 5,515,574 | A * | 5/1996 | Larson | B25G 1/04 15/144.4 |
| 5,651,744 | A * | 7/1997 | Millon | A63B 59/20 473/513 |
| 5,664,520 | A | 9/1997 | Latimer, III | |
| 5,779,386 | A * | 7/1998 | Eichhorn | A47D 13/105 403/109.3 |

(Continued)

FOREIGN PATENT DOCUMENTS

| | | | |
|---|---|---|---|
| CN | 2341345 | Y | 10/1999 |
| CN | 203762499 | U | 8/2014 |
| WO | 03/094646 | A1 | 11/2003 |

*Primary Examiner* — Chuck Mah
(74) *Attorney, Agent, or Firm* — Senniger Powers LLP

(57) ABSTRACT

An extension handle for bull floats and other tools is presented with an octagonal shaped handle. A connector end is provided to allow for additional lengths of extension to be added to the handle.

11 Claims, 5 Drawing Sheets

(56) References Cited

U.S. PATENT DOCUMENTS 5,983,455 A * 11/1999 Polzin ..... B05C 17/0205 15/144.4
6,199,245 B1 * 3/2001 Blessing ..... B25G 1/06 16/422
D453,463 S 2/2002 Chang
6,367,854 B1 4/2002 Chou
6,453,777 B1 * 9/2002 Newman ..... B25B 9/00 294/184
6,500,079 B1 12/2002 Tucker, Sr.
D469,330 S 1/2003 Novoa
6,752,730 B1 6/2004 Brine, Jr. et al.
6,854,916 B2 * 2/2005 Hsieh ..... F16B 7/105 403/109.1
7,004,671 B2 * 2/2006 Tawara ..... A47L 9/242 15/143.1
7,108,616 B2 9/2006 Morrow et al.
RE39,430 E 12/2006 Novoa
D534,227 S 12/2006 Lee
7,182,223 B2 * 2/2007 Healy ..... A01M 1/2038 222/174
D578,260 S 10/2008 Fellinger
D581,474 S 11/2008 Dickie et al.
D603,241 S 11/2009 Pearce
7,621,832 B2 * 11/2009 Morrow ..... A63B 60/10 473/513
D606,146 S 12/2009 Gedeon
D611,563 S 3/2010 Sjoberg
D621,236 S 8/2010 Bahler et al.
7,766,772 B2 8/2010 Morrow et al.
D630,927 S 1/2011 Huang
7,896,398 B2 3/2011 Suda et al.
D645,511 S 9/2011 Freeman et al.
8,016,702 B2 9/2011 Hagey
8,052,549 B2 11/2011 Sykora
D661,265 S 6/2012 Kajiya et al.
8,579,537 B2 * 11/2013 VanLandingham .. A01D 34/416 15/145
8,641,309 B2 * 2/2014 Perry ..... A47L 13/26 401/137
8,808,120 B2 8/2014 Cain
8,834,305 B2 9/2014 Cain
D714,613 S 10/2014 Jenkins
D716,510 S 10/2014 Gilbert, Jr.
D725,055 S 3/2015 Yamazaki et al.
D735,012 S 7/2015 Cowie
D735,281 S 7/2015 Janisse et al.
D735,282 S 7/2015 Burns et al.
D740,016 S 10/2015 Roberto
9,283,454 B2 3/2016 Bond
9,511,269 B2 12/2016 Morin et al.
2001/0024594 A1 * 9/2001 Taylor ..... B25G 1/04 403/109.7
2003/0110584 A1 * 6/2003 Clare ..... A47L 13/42 15/104.94
2003/0215283 A1 11/2003 Hsieh
2003/0233718 A1 * 12/2003 Heathcock ..... B25G 1/04 15/144.4
2004/0001738 A1 * 1/2004 Schipani ..... F16B 7/042 403/322.4
2006/0016047 A1 * 1/2006 Blackman ..... B25G 1/04 16/231
2006/0230581 A1 * 10/2006 Richardson ..... B25G 1/04 16/429
2006/0283284 A1 12/2006 Lin
2009/0094791 A1 * 4/2009 Blom ..... B25G 1/04 16/427
2012/0060879 A1 3/2012 Webb

* cited by examiner

| Cross-section | Type | Length of Extension (in) | Number of Extensions | Total Length (ft) | Support Length (ft) | Deflection at 0 Degrees (in) | Deflection at 90 Degrees (in) | Deflection at 180 Degrees (in) | Deflection at 270 Degrees (in) | Average Deflection (in) |
|---|---|---|---|---|---|---|---|---|---|---|
| Octagon | Swaged | 72 | 4 | 24 | 20 | 1.97 | 1.88 | 1.69 | 1.69 | 1.80 |
| Octagon | Swaged | 72 | 4 | 24 | 20 | 1.78 | 1.69 | 1.69 | 1.56 | 1.68 |
| Octagon | Insert | 72 | 4 | 24 | 20 | 3.00 | 3.31 | 3.13 | 3.06 | 3.13 |
| Octagon | Insert | 72 | 4 | 24 | 20 | 3.00 | 3.06 | 3.00 | 3.00 | 3.02 |
| Octagon | Insert | 72 | 4 | 24 | 20 | 3.00 | 2.81 | 3.06 | 2.81 | 2.92 |
| Circle | Swaged | 72 | 4 | 24 | 20 | 1.88 | 1.91 | 2.00 | 2.06 | 1.96 |
| Circle | Swaged | 72 | 4 | 24 | 20 | 1.88 | 1.88 | 1.91 | 1.81 | 1.87 |
| Circle | Swaged | 72 | 4 | 24 | 20 | 1.88 | 1.88 | 2.06 | 2.06 | 1.97 |
| Circle | Insert | 72 | 4 | 24 | 20 | 2.38 | 2.44 | 2.44 | 2.56 | 2.45 |
| Circle | Insert | 72 | 4 | 24 | 20 | 2.75 | 3.00 | 2.69 | 2.81 | 2.81 |
| Circle | Insert | 72 | 4 | 24 | 20 | 2.94 | 2.63 | 2.75 | 2.81 | 2.78 |

Fig. 11

Comparison of Deflection for Swaged and Insert Poles

| Test Subject | One Hand | | Two Hands | | Percent Increase | |
|---|---|---|---|---|---|---|
| | Circular Handle | Octagonal Handle | Circular Handle | Octagonal Handle | 1 Hand | 2 Hand |
| 1 | 30 | 25 | 55 | 70 | -17% | 27% |
| 2 | 75 | 75 | 94 | 94 | 0% | 0% |
| 3 | 25 | 30 | 90 | 87 | 20% | -3% |
| 4 | 65 | 50 | 75 | 100 | -23% | 33% |
| 5 | 35 | 45 | 52 | 85 | 29% | 63% |
| 6 | 35 | 35 | 95 | 85 | 0% | -11% |
| 7 | 52 | 52 | 100 | 145 | 0% | 45% |
| 8 | 50 | 50 | 127 | 127 | 0% | 0% |
| 9 | 60 | 55 | 110 | 145 | -8% | 32% |
| 10 | 35 | 45 | 55 | 60 | 29% | 9% |
| 11 | 75 | 94 | 135 | 165 | 25% | 22% |
| 12 | 15 | 25 | 40 | 50 | 67% | 25% |
| 13 | 90 | 120 | 180 | 210 | 33% | 17% |
| 14 | 55 | 55 | 160 | 170 | 0% | 6% |
| 15 | 45 | 60 | 100 | 150 | 33% | 50% |
| 16 | 60 | 90 | 125 | 130 | 50% | 4% |
| | | | | Average | 15% | 20% |

Fig. 12

Comparison of Rotational Force of Circular and Octagonal Handles (Rotational force in inch pounds)

OCTAGONAL EXTENSION HANDLE

CROSS-REFERENCE TO RELATED APPLICATIONS

The present application is a continuation-in-part of and claims priority to U.S. Design patent application Ser. No. 29/488,143 filed Apr. 16, 2014, the disclosure of which is hereby incorporated by reference in its entirety.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

The present invention relates to a handle device used with tools. In particular, the invention relates to an octagonally-shaped extension handle having a connection end for attachment of additional lengths of handle.

When performing various types of construction and home-improvement projects, it is often necessary to perform tasks at a distance from the worker. Such tasks include, among others, painting ceilings or floating concrete. Many of these tasks are made easier when the craftsman is able to easily grip the handle for her tool. Handles are typically circular as this structure can be easily connected to a variety of tools and extension lengths. However, a circular handle becomes slick from sweat or rain, increasing slippage of the handle. Thus, it is desirable to have a handle that provides an improved surface for gripping.

Importantly, it is difficult to secure handles having an octagonal circumference to other devices or other extension handles. Use of an octagonal circumference in conjunction with a circular circumference is known in other applications. One such device is described in Chinese Patent Publication 203762499 published to Lai-Cheng on Aug. 13, 2014 entitled With One-way Pushing Function of Liquid Cosmetic Pencil. Lai-Cheng depicts a driving tube having an octagonal circumference enclosed within a pen barrel having a circular circumference. However, the driving tube does not secure to other tubes of similar circumference nor does it secure to other tubes of circular circumference. Lai-Cheng does not show an effective way of providing the gripping benefits of a handle having an octagonal circumference with the connection of a circular handle.

Another such device is shown in U.S. Pat. No. 8,016,702 issued to Hagey on Sep. 13, 2011 entitled Contoured Hand Grip Constructions for a Racquet teaches a handle shaft with a slidable contour sleeve having an octagonal exterior shape that fits around the interior shaft. The exterior sleeve has an interior shape conforming to the handle shaft shape to allow the exterior to be received on the handle shaft for attachment thereto. This arrangement allows for engagement with a smaller diameter circular shaft, but does not allow for a pairing of an octagonal handle and circular handle having a similar diameter, nor does it allow for joining of two octagonal handles having the same diameter.

U.S. Pat. No. 7,108,616 issued to Morrow et al. on Sep. 19, 2006 entitled Lacrosse Stick with Replaceable Modular Handle Section teaches a sectional handle being composed of substantially hollow tubing, an interlocking mechanism for the sectional handle, and a head. The sectional handle includes an upper elongate section having both a top end and a locking bottom end and a lower elongate section having both a locking top end and a bottom end. As illustrated in Morrow, the hollow tubing of the sectional handle has a cross-section that substantially resembles the shape of an octagon to thereby facilitate favorable hand gripping with minimal slippage. However, Morrow does not teach a swaged transition of an octagonal cross-section to a circular cross-section, nor does Morrow teach a connection of any extensions to the sectional handle.

International Patent Publication No. WO/03094646 published to Manners on Nov. 20, 2003 entitled Shoe Stud Fitting and Removal Tool teaches a tool having a head portion with means to engage a selected shoe stud, said means configured to transfer rotational movement of said head portion to a said selected shoe stud engaged with said means, the tool further comprising means for connecting said tool to a rotary drive apparatus, said means for connecting configured to transfer rotational movement from said rotary drive apparatus to said head portion.

U.S. Pat. No. 6,367,854 issued to Chou on Apr. 9, 2002 entitled Handle Device of an Impact Hand Tool teaches a handle with a circular rod with a welded or shaped rectangular portion for engagement with a confining cover, which is a rectangular sleeve. Likewise, Chinese Patent No. 2,341,345 issued to Wu on Oct. 6, 1999 entitled Handle for Positioning Tools teaches a circular tube handle provided with a positioning mechanism within the circular tube to receive an interior faceted handle. Both Chou and Wu are hand tools and the engagement of a faceted tube piece within a circular handle portion when the handles portions are short in length does not provide the deflection issues which occur when the length of the handle is elongated. Likewise, the use of the faceted ends within the circular portion allows for a secured fit as the interior of the circular portion can be shaped to fit the faceted end. Conversely, providing a circular end piece for engagement within a faceted elongated handle presents issues of added weight and positioning of the engaged portion that the smaller handles shown in Chou and Wu do not accommodate for. Thus, there is a need in the art for the present invention.

However, these prior art extension handles and poles and others like them suffer from a number of deficiencies. Thus, there is a need in the art to provide an extension handle which provides an improved gripping surface that can be easily extended. The present invention satisfies these and other needs.

SUMMARY OF THE INVENTION

In order to overcome the above-stated problems and limitations, and others, and to achieve the noted objects, there is provided an octagonal handle having a swaged end.

Bull float handles are elongated handles that stretch from the bull float handle attachment to the user. Sometimes, these handles extend a great distance between the bull float and the user. It is necessary that these handles provide a lightweight extension that allows a user to float the concrete for extended periods without excessive tiring and without sagging.

Conventional handles are circular, which do not provide resistance or a good gripping surface. Faceted handles, in contrast, increase grip and provide slip-resistance, even with wet or sweaty hands. Testing has shown that an octagonal handle provides increased grip strength by an average of 20%. Therefore, it is an object of the present invention to provide an elongated handle that improves grip strength.

However, the faceted or octagonal design of the handle provides additional challenges for use. Elongated handles are typically connected to provide further extension. The octagonal handle must be adapted to allow for extension. Therefore, it an object of the present invention to provide for an extendable elongated octagonal handle.

Bull float brackets and other handles still provide circular cross-sections. Therefore, it is an object of the present invention to provide for an elongated octagonal handle which can connect to circular handles and brackets.

As elongated handles are extended, weight is added with each handle. Additionally, as more handles are added, the handles begin to sag. If the handle is used with a tilt bracket, like one provided by Marshalltown Company and known commercially as the Rock-It®, handle sag makes turning the handle difficult. This increases fatigue for the user. Therefore, it is an object of the present invention to decrease handle sag.

The grip surface of the handle is equally important in the tool it is used with. With larger tools, such as channel bull floats, bump cutters, and check rods, more effort is necessary to pitch the tool and keep in place. With concrete tools, the user also has to break the suction force between the tool and the surface of the concrete. The faceted handle provides a better gripping surface when using wide tools.

Further objects, features, and advantages of the present invention over the prior art will become apparent from the detailed description of the drawings which follows, when considered with the attached figures.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein:

FIG. 11 is a table showing the results of different trials of deflection for handles; and FIG. 12 is a table showing the results of different trials of rotational force for handles.

DETAILED DESCRIPTION OF THE INVENTION

Figure 1:
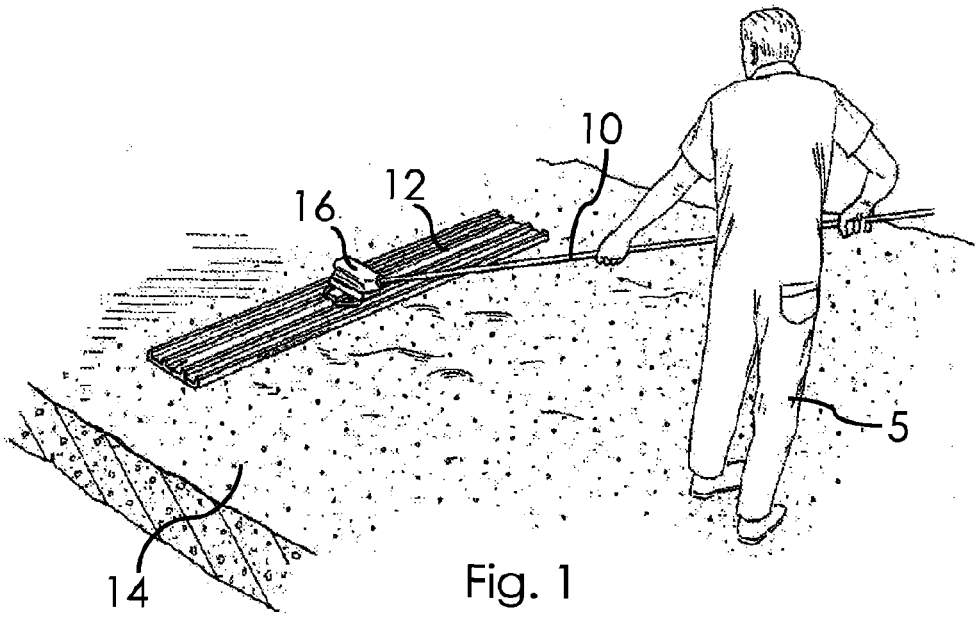
Fig. 1 (prior art)
FIG. 1 is a perspective view showing a workman using a bull float having an extension handle of the prior art.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

It will be understood that, although the terms first, second, etc. may be used herein to describe various elements, these elements should not be limited by these terms. These terms are only used to distinguish one element, from another element. For instance, a first element discussed below could be termed a second element without departing from the teachings of the present invention. Similarly, the second element could also be termed the first element.

The term "and/or" includes any and all combinations of one or more of the associated listed items. The terminology used herein is for the purpose of describing particular embodiments only and is not intended to be limiting. As used herein, the singular forms "a," "an" and "the" are intended to include the plural forms as well, unless the context clearly indicates otherwise.

It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof.

As used herein, the term "deflection" refers to bending or displacement of at least part of the handle, either as a single piece or as elongated by multiple pieces.

As used herein, the term "rotational force" refers to the force applied by the user for rotating the handle.

Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Referring now to the drawings, in which like numerals represent like components throughout the several views, the preferred embodiments of the present invention are next described. The following description of one or more preferred embodiment(s) is merely exemplary in nature and is in no way intended to limit the invention, its application, or uses.

As depicted in FIG. 1, the prior art teaches an elongated tubular handle 10 is employed by a user 5 to move a float 12 across a wet concrete surface 14. The float 12 is connected to the handle 10 by a bracket 16.

Figure 2:
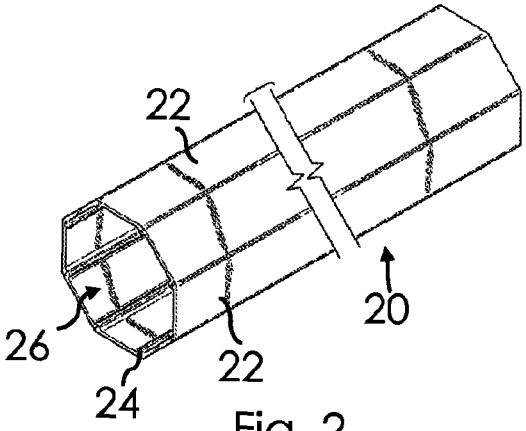
FIG. 2 is a perspective view of a portion of an octagonal extension handle of the present invention.
Figure 3:
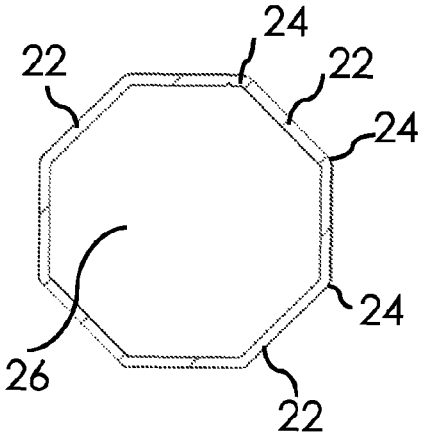
FIG. 3 is a front side view of the octagonal extension handle of the present invention.
Figure 4:
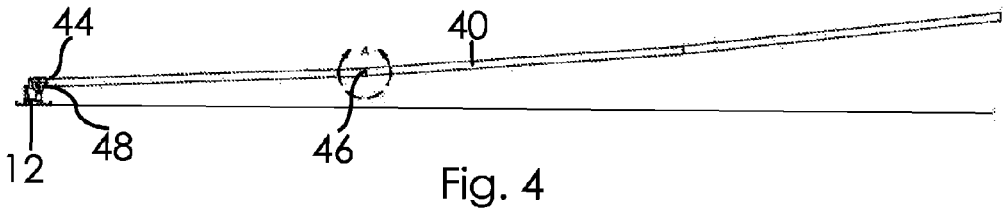
FIG. 4 is a right side elevational view of a bull float having an octagonal extension handle with an intermediary connector.

The present invention provides an elongated faceted shaft handle 20 constructed of aluminum or other suitable material. Multiple facets are desirable as the number of facets assist in providing grip and increase rotational force. At least five facets are preferred, as fewer facets provide a handle that is uncomfortable for use over long periods of time. As shown in FIGS. 2-3, the handle 20 has an octagonal cross-section with eight facets 22 connected edge to edge forming a vertices 24 between the edges. The elongated handle 20 is substantially hollow with an open interior 26 to reduce the weight of the handle 20. Referring to FIG. 4, the deflection of the handle 40 with the use of the interior connector 50 (shown in FIG. 5-6) is shown with the handle 40 connected to the tool 12 at connection point 48. As shown, the sag or deflection of the handle with the connector 50 is illustrated. The measured deflection of the handle 40 is discussed more below.

Figure 5:
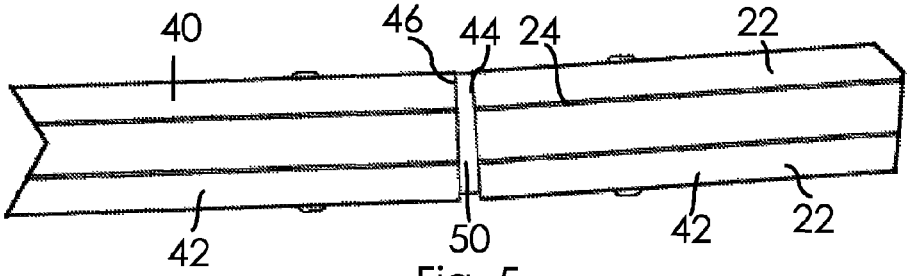
FIG. 5 is a close-up view of section A of FIG. 2, showing the connection of the octagonal extension handle having an intermediary connector.
Figure 6:
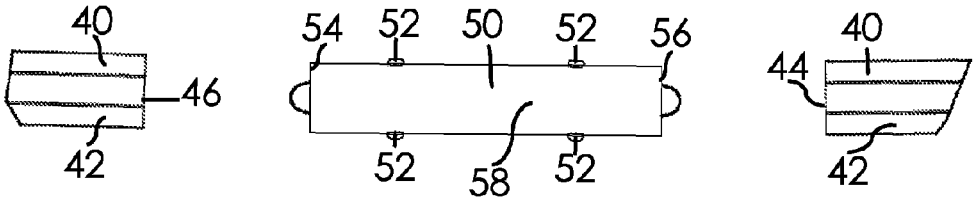
FIG. 6 is an exploded view of section A of FIG. 2, showing the intermediary connector of the octagonal extension handle.

In one embodiment of the present invention shown in FIGS. 4-6, the handle 40 has an octagonal gripping portion 42 that extends between two ends 44, 46. At each end, apertures for connection to an interior connector 50 are provided in the handle to allow for engagement of fasteners or quick connect snap spring connectors to engage with the handle 20. FIG. 5 provides detail of FIG. 4 at Section A. FIG. 5 shows the interior connector 50 partially exposed as the handle 40 is connected to a subsequent handle 41. As shown in FIG. 6, the interior connector 50 has snap spring connectors 52 on each end 54, 56 of the internal connector 50.

Figure 7:
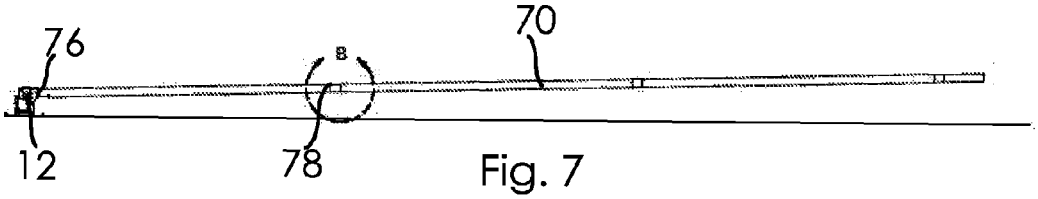
FIG. 7 is a right side elevational view of a bull float having an octagonal extension handle with a swaged end.
Figure 8:
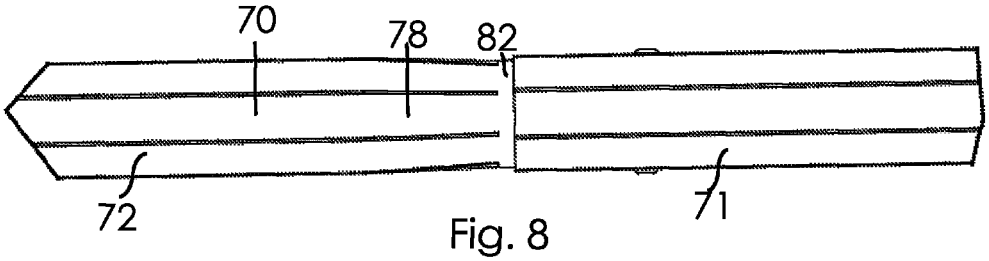
FIG. 8 is a close-up view of section B of FIG. 5, showing the swaged connection of the octagonal extension handle.
Figure 9:
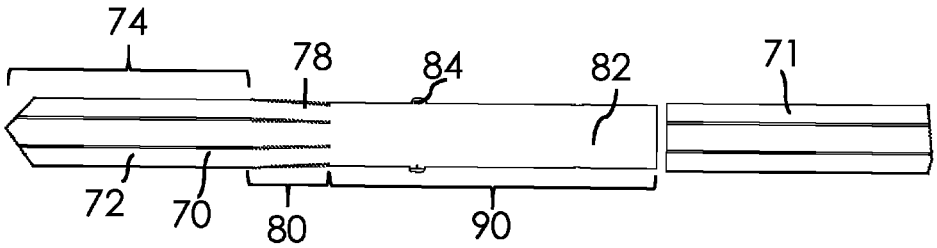
FIG. 9 is an exploded view of section B of FIG. 5, showing the swaged connection end of the octagonal extension handle.

Referring to FIGS. 7-9, the second embodiment of the present invention is presented. The handle 70 has an octagonal gripping portion 72 which extends a length 74 from a first end 76 to a swaged portion 78. The swaged portion 78 extends a length 80 from the octagonal gripping portion 72 to the circular end portion 82. The circular end portion 82 extends a length 90 to the end of the handle 70. The circular end 82 length 90 is preferably between approximately three inches and approximately six inches in length as its minimum length. As can be appreciated, the length 90 can extend the length of the next extension handle, however, additional length increases weight and does not improve deflection. The circular end 82 length 90 must be within a range suitable for engagement with other handles 70 or the deflection benefits of the swaged handle are lost. At the circular end portion 82, fasteners or quick connect snap spring connectors 84 for connection to a subsequent handle 71 are provided in the handle 70 to allow for engagement of apertures in the subsequent handle 71 to engage with the handle 71.

Figure 10:
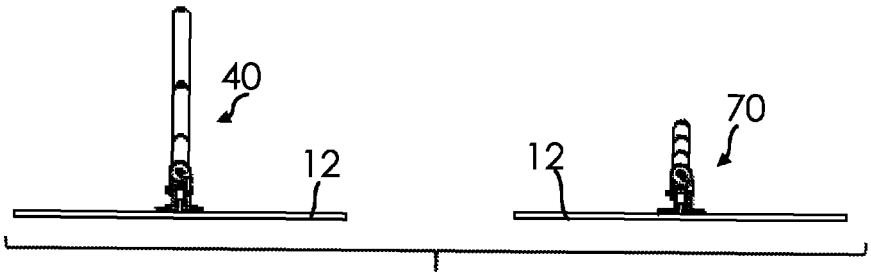
FIG. 10 is a front elevational view comparison of the extension handle arrangement of FIG. 2 and the extension handle arrangement of FIG. 5.

It has been discovered that the use of the swaged end of the handle can substantially reduce deflection in contrast to the use of the circular handle and the circular connectors 50 used with the octagonal pole. This was determined by conducting preliminary experiments with multiple handles of each type of handle. As shown in FIG. 10, the octagonal handle 40 with the internal connector 50 is depicted on the left and the swaged octagonal handle 70 is depicted on the right. As shown in preliminary results provided in FIG. 11, Applicant has measured deflection across a twenty foot span for the octagonal insert handle 40, the octagonal swaged handle 70, for circular handles with an insert and for circular handles with a swaged end. The handles are noted in FIG. 11 by their cross-sectional shape of octagon or circle and whether the handle has an insert or a swaged end. In each test, four 72 inch extensions were used to form a complete handle extension measuring 24 feet in length. All handles were supported at a Point A and a Point B on either side of the twenty foot span and the deflection between the points was measured in inches.

To assess the deflection of the four types of handles, Applicant measured the exact deflection at 0°, 90°, 180°, and 270°. The average deflection for all four points can be ascertained. As shown in FIG. 11, the average deflection for the octagonal swaged handle 70 was measured at 1.74 inches, which is reduced significantly in comparison to the other handles. The average deflection for the octagonal handle 40 with the internal connector 50 was measured at 3.02 inches. The average deflection for the circular handle 10 with a swaged end was measured at 1.93 inches and the average deflection for the circular handle 10 with an insert was measured at 2.68 inches. This improved reduction of deflection of the handle across a span of twenty feet shown in the preliminary experiments illustrates the need for the swaged octagonal handle of the present invention.

It has additionally been discovered that the use of the octagonal handle can substantially increase the grip of the handle in contrast to the use of the circular handles. This was determined by conducting trials and additional field tests. FIG. 12 provides tests results measuring the increased rotational force on the octagonal handle compared to the circular handle. As shown in the example trial depicted in FIG. 11, the average increase of rotational force for one handed use is 15% and for two handed use is 20%. This improved rotational force illustrates the need for the octagonal grip portion of the present invention.

It will be understood that certain features and subcombinations are of utility and may be employed without reference to other features and subcombinations and are contemplated within the scope of the claims.

What is claimed is:

1. An extension handle for attachment to a tool, the handle comprising:

a first elongated handle member comprising a gripping portion having an octagonal cross section, an attachment portion having a circular cross section, and a swaged portion between said gripping portion and said attachment portion; and a second elongated handle member comprising a gripping portion having an octagonal cross-section forming an end portion of the handle member and defining an octagonal passage extending through at least the end portion of the handle member, wherein the attachment portion of the first elongated handle member is configured to be matably received in the octagonal passage of the second elongated handle member and to be secured to the second elongated handle member therein to form the extension handle.

2. The extension handle of claim 1, wherein a minimum axial length of said circular cross section is approximately 6 inches.

3. The extension handle of claim 1, wherein a minimum axial length of said circular cross section is between approximately 3 inches and approximately 6 inches.

4. The extension handle of claim 1, wherein the gripping portion of the second elongated handle member has an interior surface defining the octagonal passage and the attachment portion of the first elongated handle member has an exterior surface, the exterior surface of the attachment portion directly engaging the interior surface of the gripping portion when the attachment portion is matably received in the octagonal passage.

5. An extension handle for attachment to a tool, the handle comprising:

a first elongated handle member having a first end portion and a second end portion and a length extending from the first end portion to the second end portion, the first end portion of the first elongated handle member having a faceted cross section having at least five edges and at least five vertices and the second end portion of the first elongated handle member having a circular cross section; and a second elongated handle member having a first end portion and a second end portion and a length extending from the first end portion to the second end portion, the first end portion of the second elongated handle member having a faceted cross section having at least five edges and at least five vertices and defining a passage having a faceted cross section having at least five edges and at least five vertices, wherein the second end portion of the first elongated handle member is configured to be matably received in the passage of the first end portion of the second elongated handle member and to be secured to the second elongated handle member therein to form the extension handle.

6. The extension handle of claim 5, wherein the first elongated handle member further comprises a swaged portion between said first end portion and said second end portion.

7. The extension handle of claim 5, wherein a minimum axial length of said circular cross-section is approximately 3 inches (7.62 cm).

8. The extension handle of claim 5, wherein a minimum axial length of said circular cross-section is between approximately 3 inches (7.62 cm) and approximately 6 inches (15.24 cm).

9. A handle comprising:

a first handle member having a first end and a second end and a length extending therebetween, said first handle member comprising: a grip portion having an octagonal cross section and extending from the first end along a first portion of said length; a circular portion having a circular cross-section and extending from the second end along a second portion of said length; a swaged portion positioned between said grip portion and said circular portion;

a second handle member having a first end and a second end and a length extending therebetween, said second handle member comprising a grip portion having an octagonal cross section and extending inward from the first end along at least a portion of the length of the second handle member, the grip portion of the second handle member defining a passage for matably receiving the circular portion of the first handle member therein, the passage extending inward from the first end of the second handle member along a length that is at least as long as the second portion of the length of the first handle member and having a non-circular cross section that is sized and arranged for matably receiving the circular cross-section of the circular portion of the first handle member therein.

10. The handle of claim 9, wherein a minimum axial length of said circular cross-section is approximately 6 inches (15.24 cm).

11. The handle of claim 9, wherein a minimum axial length of said circular cross-section is between approximately 3 inches (7.62 cm) and approximately 6 inches (15.24 cm).

* * * * *